US011317739B2

(12) United States Patent
Kerr et al.

(10) Patent No.: US 11,317,739 B2
(45) Date of Patent: May 3, 2022

(54) MODULAR PUSHER AND HANG DISPLAY SYSTEM

(71) Applicant: DIAM UK LTD, Loughborough (GB)

(72) Inventors: Eamonn Kerr, Whetstone (GB); Howard Gaskin, Loughborough (GB)

(73) Assignee: DIAM UK LTD, Loughborough (GB)

( * ) Notice: Subject to any disclaimer, the term of this patent is extended or adjusted under 35 U.S.C. 154(b) by 0 days.

(21) Appl. No.: 17/248,540

(22) Filed: Jan. 28, 2021

(65) Prior Publication Data

US 2021/0227996 A1 Jul. 29, 2021

Related U.S. Application Data

(60) Provisional application No. 62/967,428, filed on Jan. 29, 2020.

(51) Int. Cl.

| | |
|---|---|
| ***A47F 1/12*** | (2006.01) |
| ***A47F 5/00*** | (2006.01) |
| ***A47F 5/08*** | (2006.01) |

(52) U.S. Cl.

CPC ..... *A47F 1/126* (2013.01); *A47F 1/128* (2013.01); *A47F 5/005* (2013.01); *A47F 5/0006* (2013.01); *A47F 5/0823* (2013.01)

(58) Field of Classification Search

CPC ..... A47F 1/125; A47F 1/128; A47F 1/126; A47F 5/08; A47F 5/0823; A47F 5/0869; A47F 5/0876; A47F 7/143; A47F 7/144

USPC ..... 211/59.3, 51, 59.1, 57.1, 54.1, 7, 126.15

See application file for complete search history.

(56) References Cited

U.S. PATENT DOCUMENTS

| | | | | | |
|---|---|---|---|---|---|
| 2,954,129 | A * | 9/1960 | Gordon | A47F 1/121 | 211/59.3 |
| 4,865,205 | A * | 9/1989 | Thorneburg | A47F 7/10 | 211/59.1 |
| 5,009,334 | A * | 4/1991 | Bodkins | A47F 1/128 | 211/54.1 |
| 5,131,563 | A * | 7/1992 | Yablans | A47F 1/126 | 221/124 |
| 5,240,125 | A * | 8/1993 | Kunz | A47F 1/126 | 211/59.3 |
| 5,425,461 | A * | 6/1995 | Larson | A47F 5/0838 | 211/59.1 |
| 5,665,304 | A * | 9/1997 | Heinen | A47F 1/126 | 108/110 |
| 5,671,851 | A * | 9/1997 | Johnson | A47F 1/128 | 211/106 |
| 5,746,328 | A * | 5/1998 | Beeler | A47F 1/126 | 211/59.3 |
| 5,855,282 | A * | 1/1999 | Hardy | A47F 5/0823 | 211/59.1 |

(Continued)

FOREIGN PATENT DOCUMENTS

| | | | | |
|---|---|---|---|---|
| GB | 2304102 A * | 3/1997 | ..... | A47F 5/0869 |
| NL | 1001794 C2 * | 6/1997 | ..... | A47F 5/0838 |

*Primary Examiner* — Jennifer E. Novosad

(74) *Attorney, Agent, or Firm* — Gottlieb Rackman & Reisman PC

(57) ABSTRACT

A product display module comprises a body with a base, a back wall extending upwards from the base, a hang bar coupled to the back wall and extending over the base, and a spring loaded pusher assembly slidably mounted to the base. Each module can include at least one side wall. Multiple modules can be ganged together and coupled to a mounting plate to provide a product display system.

26 Claims, 10 Drawing Sheets

(56) References Cited

U.S. PATENT DOCUMENTS 6,076,670 A * 6/2000 Yeranossian ..... A47F 1/126 206/362
7,690,519 B2 * 4/2010 Kahl ..... A47F 5/0093 211/59.2
7,828,158 B2 * 11/2010 Colelli ..... A47F 1/126 211/59.3
8,240,486 B2 * 8/2012 Niederhuefner ..... A47F 1/128 211/51
8,448,792 B2 * 5/2013 Gelardi ..... A47F 1/126 211/59.3
8,485,391 B2 * 7/2013 Vlastakis ..... A47F 3/002 221/15
8,602,230 B2 12/2013 Bergdoll et al.
8,607,997 B2 12/2013 Bergdoll et al.
8,622,227 B2 * 1/2014 Bird ..... A47F 5/0861 211/119.003
8,657,154 B2 * 2/2014 Obitts ..... G07F 11/005 221/124
8,727,457 B2 * 5/2014 Marshall ..... A47J 31/44 312/246
8,985,352 B2 3/2015 Bergdoll et al.
9,247,833 B2 * 2/2016 Pena ..... A47F 5/0861
9,254,049 B2 * 2/2016 Nagel ..... A47F 1/04
9,629,479 B2 * 4/2017 Sosso ..... A47F 5/0823
9,820,585 B2 * 11/2017 Hardy ..... A47F 5/05
10,306,997 B2 6/2019 Eizinas et al.
10,702,076 B2 * 7/2020 Mercier ..... G01B 21/16
10,729,259 B2 * 8/2020 Brej ..... A47F 5/0861
10,952,548 B2 * 3/2021 Pollpeter ..... A47F 3/001
2006/0180603 A1 * 8/2006 Eckert ..... G07F 11/16 221/279
2007/0170127 A1 * 7/2007 Johnson ..... A47F 1/126 211/59.3
2007/0175839 A1 * 8/2007 Schneider ..... A47F 3/14 211/59.3
2009/0057244 A1 * 3/2009 Conti ..... A47F 5/0861 211/7
2009/0242582 A1 * 10/2009 Vlastakis ..... G07F 11/62 221/123
2009/0277853 A1 * 11/2009 Bauer ..... A47F 1/126 211/59.3
2010/0012603 A1 * 1/2010 Takashima ..... A47F 1/12 211/59.3
2010/0032392 A1 * 2/2010 Camello ..... A47F 7/28 211/59.3
2011/0087369 A1 * 4/2011 Bauer ..... G07F 17/18 700/232
2011/0215061 A1 * 9/2011 Niederhuefner ..... A47F 1/128 211/59.3
2011/0220597 A1 * 9/2011 Sherretts ..... A47F 1/128 211/59.3
2012/0085718 A1 * 4/2012 Bergdoll ..... A47B 57/16 211/59.3
2012/0103922 A1 * 5/2012 Bird ..... A47F 1/126 211/59.3
2012/0285906 A1 * 11/2012 Bird ..... A47F 5/0068 211/4
2013/0193156 A1 * 8/2013 Kaleta ..... A47F 3/002 221/7
2014/0250749 A1 * 9/2014 Theisen ..... A47B 96/027 40/649
2014/0305891 A1 * 10/2014 Vogler ..... A47F 5/0846 211/59.3
2014/0319086 A1 * 10/2014 Sosso ..... A47F 1/125 211/59.3
2014/0319087 A1 * 10/2014 Sosso ..... A47F 1/126 211/59.3
2015/0076093 A1 * 3/2015 Theisen ..... A47F 5/0043 211/85.26
2015/0108074 A1 * 4/2015 Pichel ..... A47F 1/126 211/59.3
2015/0196138 A1 * 7/2015 Juric ..... A47F 5/0025 211/59.3
2015/0208830 A1 * 7/2015 Hardy ..... A47F 1/12 211/59.3
2016/0007769 A1 * 1/2016 Gray ..... A47F 1/125 221/1
2019/0104847 A1 * 4/2019 Pellegrino ..... A47B 96/1408
2019/0125101 A1 * 5/2019 Pozzi ..... A47B 57/58
2019/0223627 A1 * 7/2019 Standen ..... A47F 5/13
2020/0037784 A1 * 2/2020 Padvoiskis ..... A47F 5/0807
2020/0253393 A1 * 8/2020 Wills ..... A47F 1/126
2021/0161310 A1 * 6/2021 Berglund ..... A47F 1/126
2021/0227996 A1 * 7/2021 Kerr ..... A47F 5/005

* cited by examiner

MODULAR PUSHER AND HANG DISPLAY SYSTEM

CROSS-REFERENCE TO RELATED APPLICATIONS

This application claims priority to U.S. Provisional application Ser. No. 62/967,428 filed Jan. 29, 2020, the entire contents of which is expressly incorporated by reference. This application is also related to U.S. Design patent application Ser. No. 29/722,427, filed Jan. 29, 2020.

FIELD OF THE INVENTION

The present invention relates to components of a system for displaying merchandise and more particularly to a pusher hang bar module and a product display system including the system.

BACKGROUND

There are various ways to display merchandise to a consumer in a retail establishment. In one configuration various square or rectangular product display units are mounted to a frame and arranged in rows and columns to form a wall-type display. Each display unit can have a configuration specific for the merchandise at issue and different unit configurations can be provided to present merchandise in in different ways throughout the system. For example, units can be configured as a container with simple dividers for storing loose items, with multiple hang bars for displaying hanging items, and with pusher trays for holding boxed items pressed against the front of the container. Often the number of dividers, hang bars or pushers, etc. desired within a given display unit will need to be configured based on the specific product at issue and this frequently needs to be done on site. Likewise, the layout of a given display unit may need to be changed over time, such as to accommodate differently sized products.

Many types of products can be presented by supporting them by a hang-bar that passes through a hold in the product packaging. Multiple units are typically displayed in the same hang bar. It is important to balance the desire to allow such a system to be configured for many different product sizes and configurations with the desire to provide an effective product presentation to customers that will not detract from the look of premium products and will improve the customer engagement experience.

Conventional systems for displaying hanging items generally have a hang-bar which is attached to a peg-board display panel or similar mounting configuration. Hang bars can be repositioned by removing and replacing them in different holds in the peg-board. This system provides flexibility but is visually unappealing and the hang bars can be disconnected or knocked out of place during normal use. Multiple hang bars are generally provided adjacent to and above and below each other. To allow for increased product display density, the bars are often placed close to each other with leaving only a small amount of space between the display items. Items suspended from such a bar can easily rotate on the bar and be tangled with and/or overlap with items on adjacent bars. If an item for display has an offset hanging hole, the item may hang at an angle instead of remaining aligned. These issues can result in a messy display that is not attractive to a consumer. In addition, items presented on a hang bar may remain at the back of the bar which can decrease product visibility and make item access more difficult.

Accordingly, there is a need to provide an improved merchandise display system that is easily to assemble and reconfigure for differently sized items on site while providing a structurally rigid system.

There is a further need to provide an improved hanging product display system that can keep the displayed items aligned, avoid interference from adjacent items, and ensure that when there is at least one item on a hang bar the item is presented at the front of the display.

Yet a further need is to provide such a system that can easily be integrated with existing display frameworks.

SUMMARY

These and other needs are met by a product display module that be combined with other modules in different configurations as part of a product display system as disclosed herein. According to an embodiment, a product display module includes a base with a top surface, a front, a rear, and first and second sides. A display axis can be defined extending from the front of the base to the rear of the base along which products are displayed. A back wall extends up from the base. A hang bar is coupled to the back wall and extends outwards over the base, wherein products can be suspended from the hang bar. In addition, a spring loaded pusher assembly is provided on the base and which operates to urge products suspended from the hang bar towards the front of the module. In an embodiment the module includes a first side wall that can be permanently attached or be removably mounted. The module can also include a second side wall opposite the first and which could also be removably mounted. Multiple modules can be ganged together in a row. Coupling structures on can be provided on the modules secure adjacent modules to each other. In a ganged embodiment, all but the last module can be provided with only a first side wall wherein the first side wall of one module acting as the second side wall of an adjacent module to define a display space over the base of the adjacent module. The last module in the row can have a discrete second side wall mounted to it.

The pusher ensures that a given bar appears fully stocked until the last product is removed. The walls between modules prevent interference by products on hang bars in adjacent modules and help to ensure that products remain vertically oriented when on display by minimizing rotation of the displayed product. Modules of different widths and heights can be provided to accommodate differently sized products.

One or more modules, such as a plurality of modules ganged together side-by-side, can be attached to a mounting plate that can be configured for attachment to horizontal supports, vertical supports, or other components of a display framework. Modules can be attached to a mounting plate and configured as desired separate from the display framework. A mounting plate preconfigured with modules as desired can then be brought to the display framework and mounted as appropriate, Modules can be easily removed from the display framework by removal of the supporting mounting plate.

A single mounting plate can be used to support modules of different sizes and the modules on a mounting plate do not need to be the same size. For example, modules of different widths can be provided to allow display of differently sized merchandise. In embodiments where modules have removable side walls, two adjacent modules can be combined for use in displaying products wider than a single module.

In an embodiment, the modules are slidably coupled to the mounting plate and engage one or more lateral channels in the mounting plate. This provides flexibility in the lateral placement of each module on the mounting plate and in the number of the modules attached to the mounting plate. When multiple modules are ganged together prior to mounting, they can be slid onto the mounting plate as a combined unit.

The hang bar can be removably coupled to the back wall, preferably at multiple vertical and lateral positions to accommodate products of different heights and to allow products with offset display holes to remain centered in the module. In an embodiment, the hang bar is connected to the back wall with a bracket engages a horizontal mounting track formed in the back wall. In one configuration, the bracket can be slid onto the mounting track from the side of the module and can be slid left and right on the mounting track to adjust the lateral position of the hang bar within the module while the bracket otherwise secures the hang bar to the back wall. Several mounting tracks can be provided on the back wall at different heights and the height of the hang bar can be adjusted by selecting an appropriate mounting track when the bar is mounted to the module.

A top plate can also be provided that is mountable to the top of one or a set of ganged modules. In an embodiment coupling structures are provided on the top plate and top of the modules to allow the top plate to engage the modules by sliding it laterally over the module tops. The top plate can help secure the modules together and can also provide a further attachment point, along with the mounting plate, to mount the modules to a display framework.

A pull-out shelf can be slidably mounted to the mounting plate to provide an area where indicia describing aspects of displayed products can be placed. Indicia, such as product information, pricing, and bar code, can also be placed on a forward lip of the shelf that remains visible when the shelf is stowed. A similar area to provide indicia can be provided on a forward lip of the top plate.

A display system according to the various embodiments thus provides an effective presentation of the products while having a more premium look and feel for improved customer engagement experience relative to conventional systems.

DESCRIPTION OF THE DRAWINGS

Various features and aspects of various embodiments of the invention are disclosed in detail below with references to the accompanying drawings in which.

DETAILED DESCRIPTION

Figure 1A:
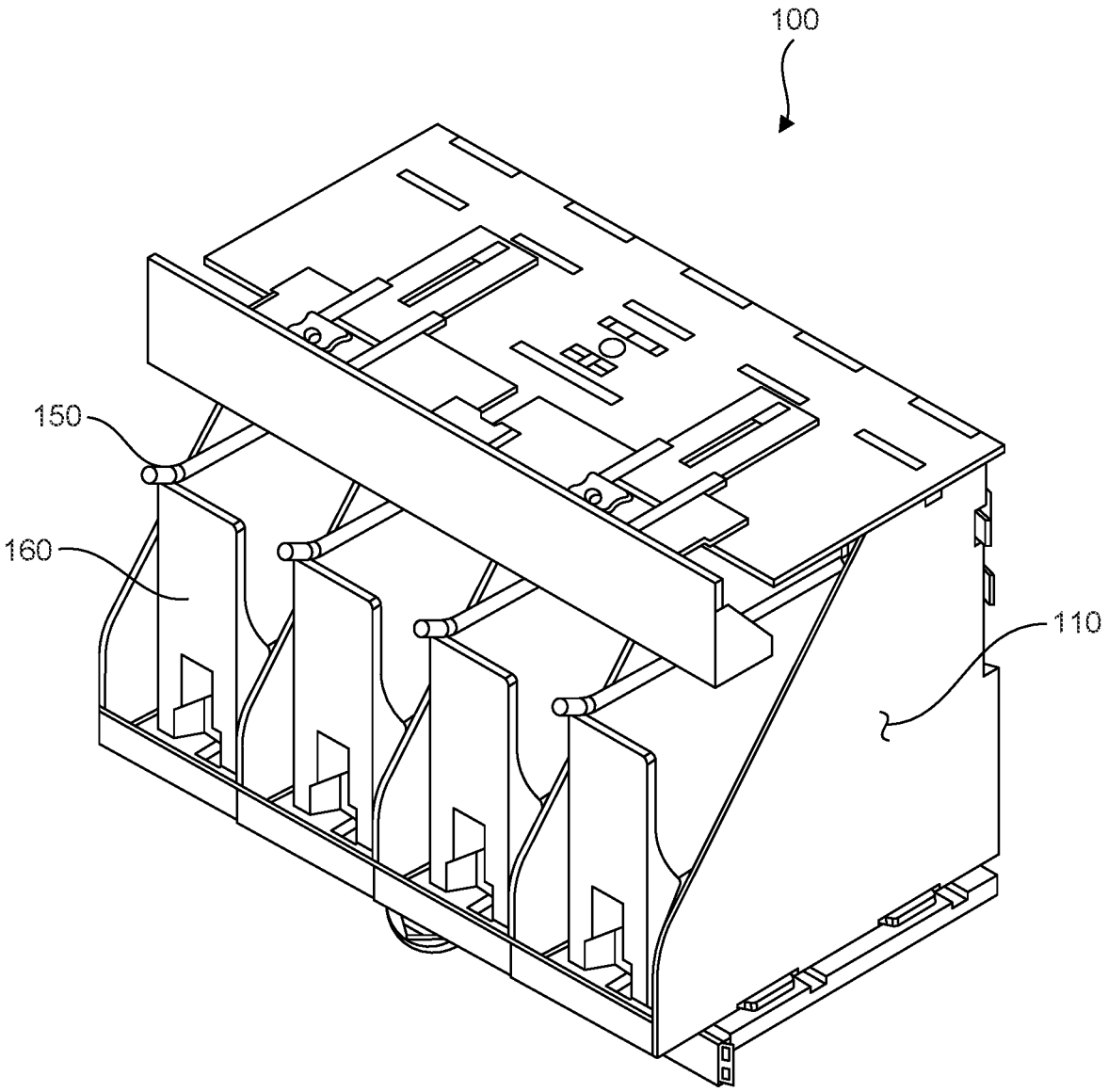
FIGS. 1A and 1B show a detail and exploded view of an embodiment of a product display according to an embodiment.
Figure 1B:
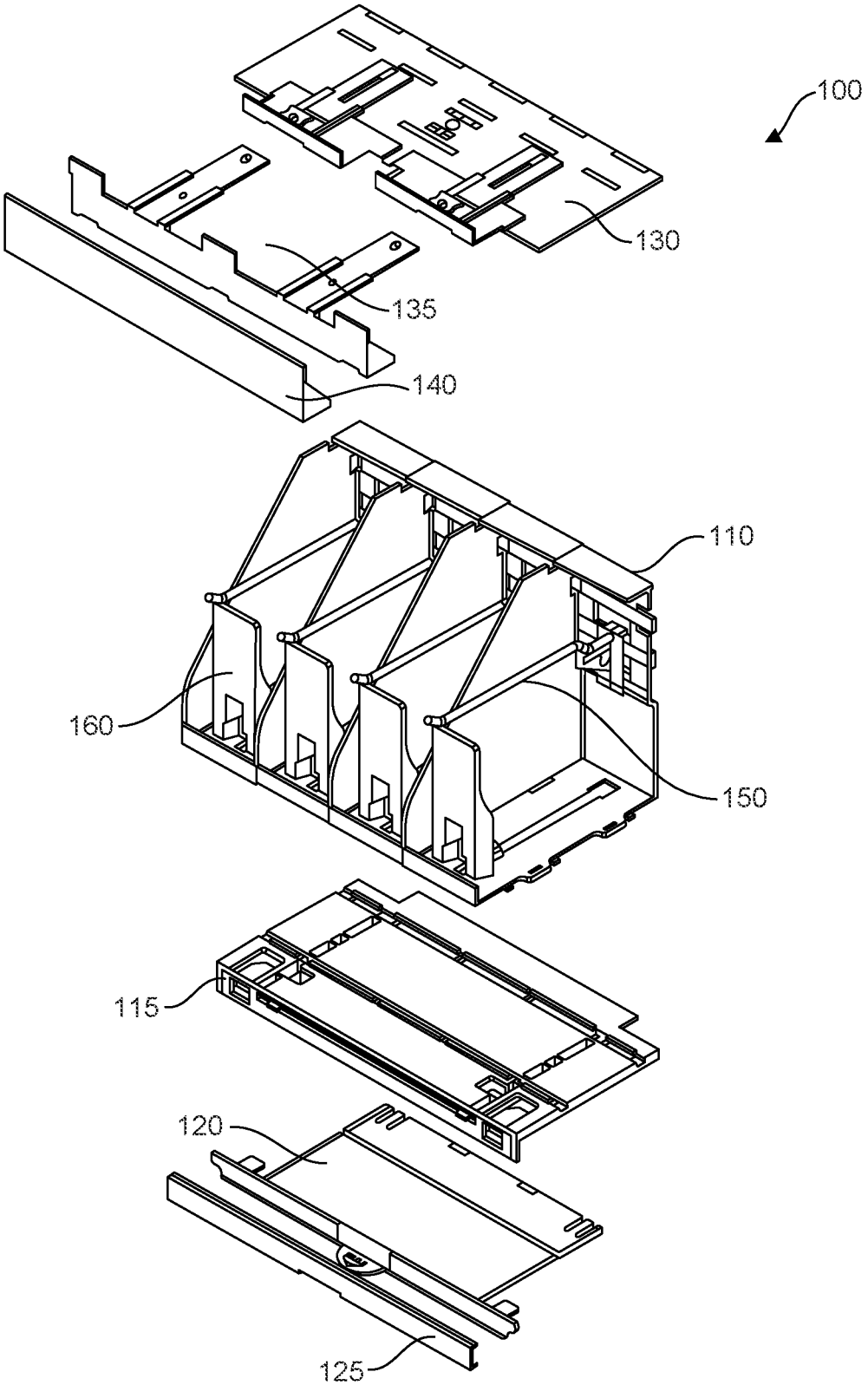
Figure 1C:
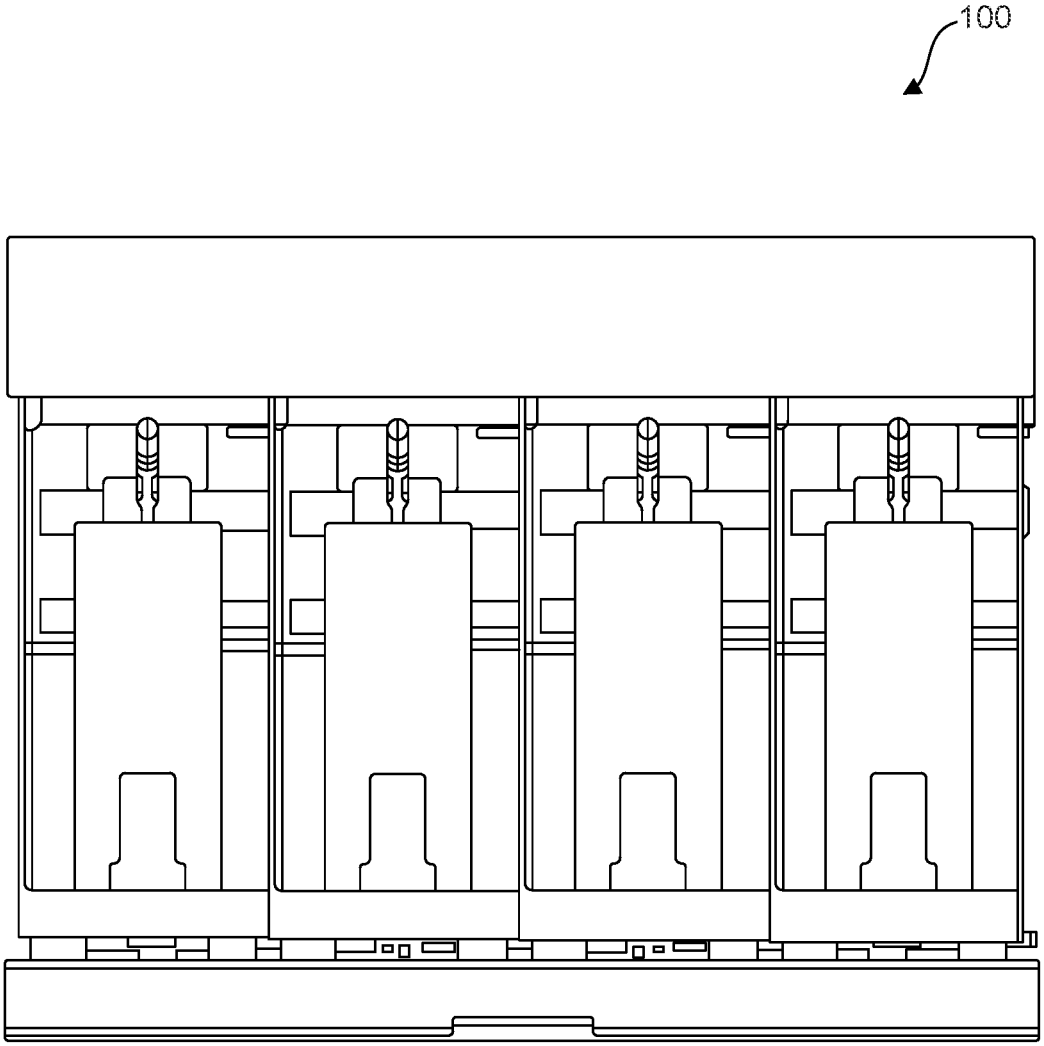
FIGS. 1C, 1D, and 1E, show the product display system of FIG. 1A from the front, side, and top respectively.
Figure 1D:
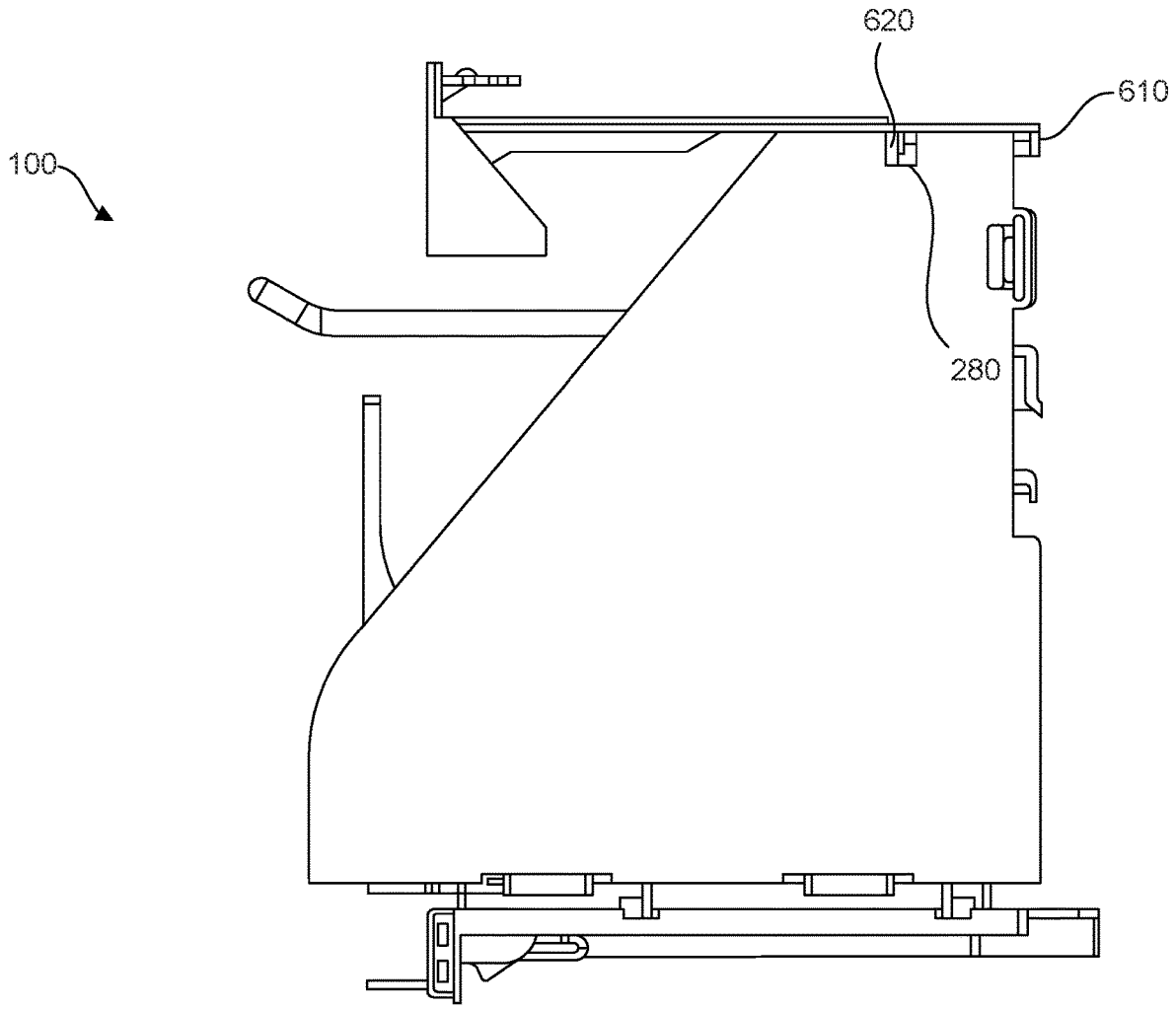
Figure 1E:
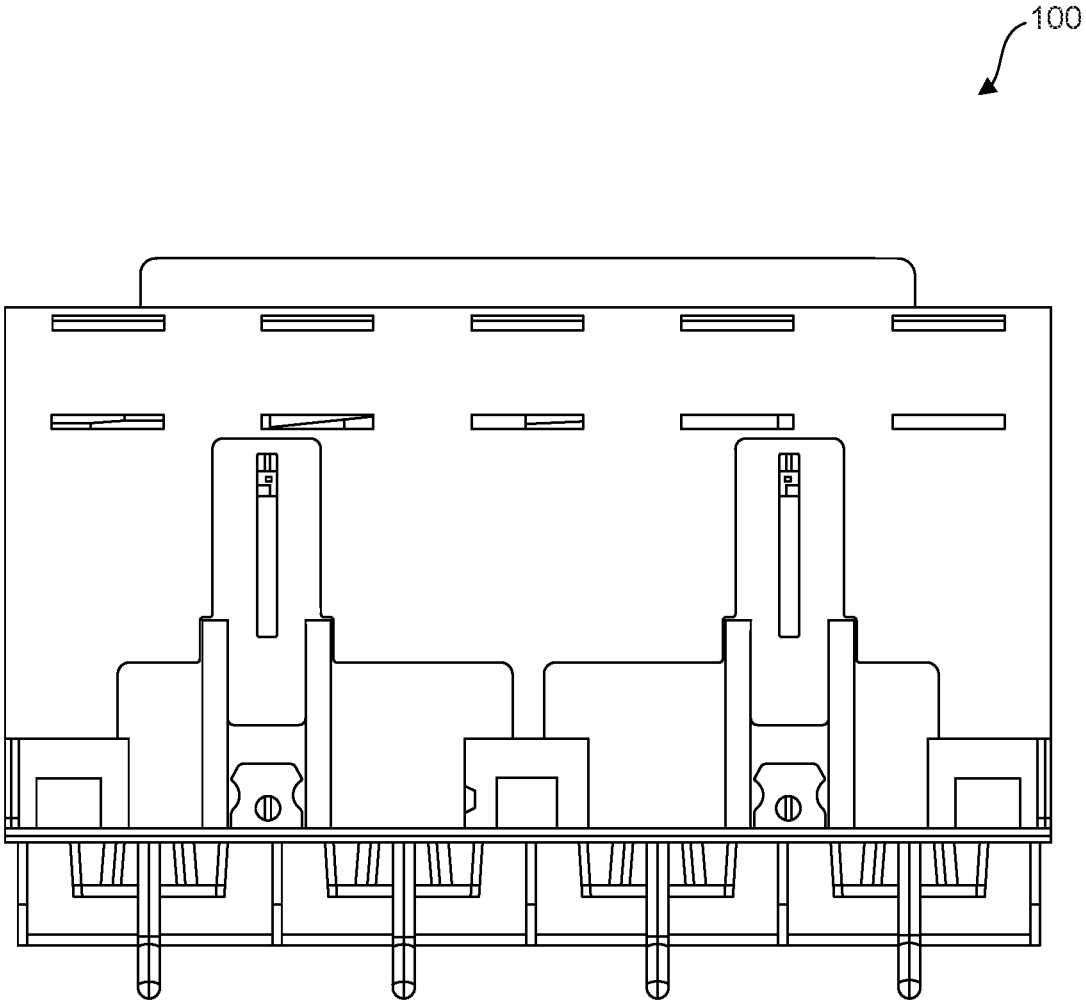

FIGS. 1A and 1B show a detail and exploded view of an embodiment of a product display system 100 that can be used for display of merchandise. Display system 100 can be mounted onto a variety of shelving and support structures (not shown). Multiple display systems 100 can be combined on such structures and display system 100 can be used in combination with other types of merchandise display hardware. FIGS. 1C, 1D, and IE, show the product display system of FIG. 1A from the front, side, and top respectively.

With particular reference to FIG. 1B, system 100 is comprised of one or more display modules 110. As discussed in more detail below, each display module 110 combines a hang bar 150 from which merchandise can be suspended and a bottom-mounted spring-loaded pusher 160 that urges merchandise to the front of the display module 110. The system is configured so that when products are placed in a given display module, an instance of the product will be pushed to the front of the module and remain aligned without being tangled or mixed up with other products in the same display module or adjacent display modules. While the embodiments disclosed herein are illustrated with the hang bar 150, in an alternative embodiment, the module 110 could be used without a hang bar. Likewise, in another alternative embodiment, the module 110 could be provided with hang bar 150 but without the pusher 160.

Multiple display modules 110 can be combined, such as by attaching them to mounting plate 115 which itself could be mounted to a shelving or support structure. For example, in FIGS. 1A and 1B four display modules 110 are shown on mounting plate 115 but more or fewer can be used, and the respective widths of modules 110 in a single assembly can be the same or different. In a particular embodiment as discussed below, each display module 110 is a single component. In an alternative embodiment, two or more display modules 110 can be combined into a joint unit separately from the mounting plate.

A pull-out shelf 120 can be mounted under the mounting plate 115 to provide a location for decorative and/or informative content, such as product images, pricing and bar code data to be displayed. Such information can be displayed on a front face of the shelf 120 to be visible when the shelf is pulled out or stowed and on a top surface of the shelf 120 and visible only when the shelf 120 is pulled out. A front cover plate 125 can also be provided.

A top plate 130 can be provided to cover the modules 110 and provide a place where decorative and/or informative content can be displayed. In an embodiment, an indicia holder assembly 135, 140 is removably mounted to the top plate 130. Indicia can be inserted between the two components 135, 140 and the indicia holder coupled to the top plate 130.

Figure 2A:
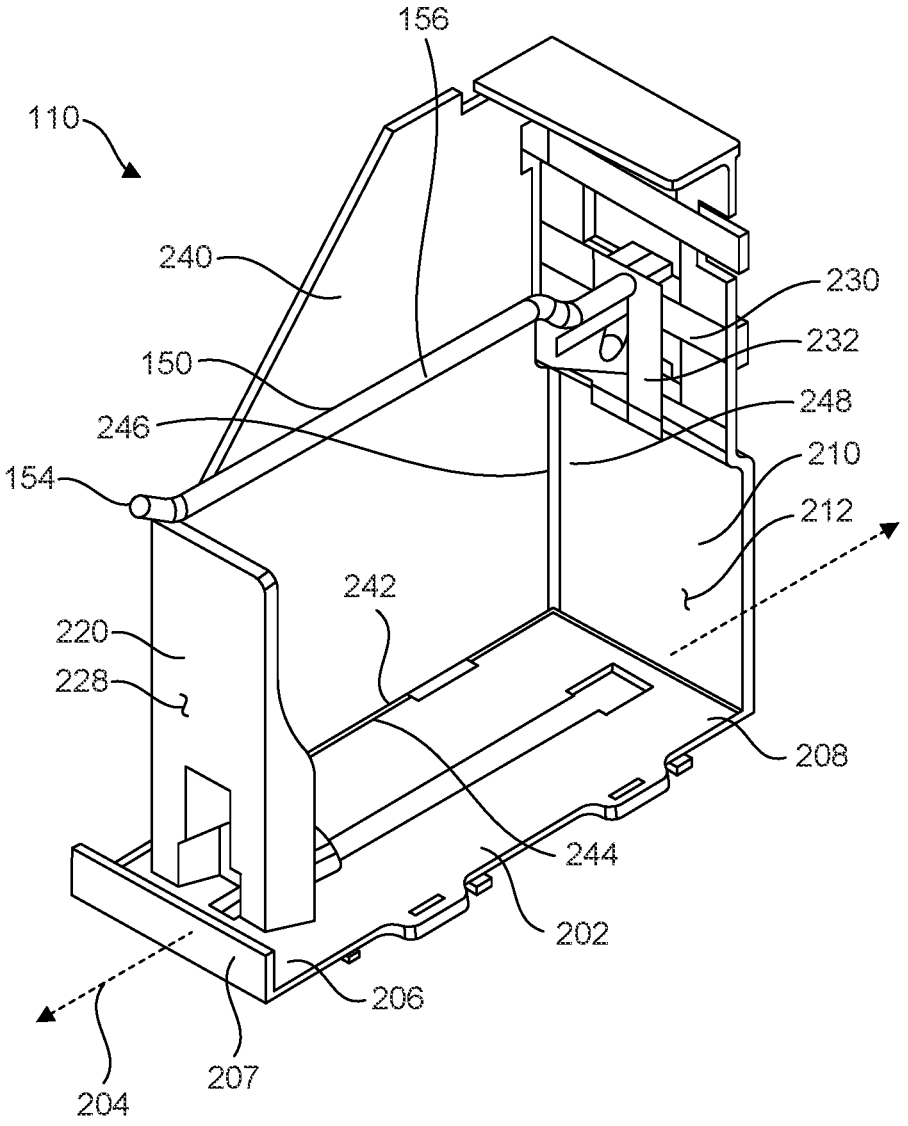
FIG. 2A shows an embodiment of a product display module of FIG. 1 with one side wall omitted.
Figure 2B:
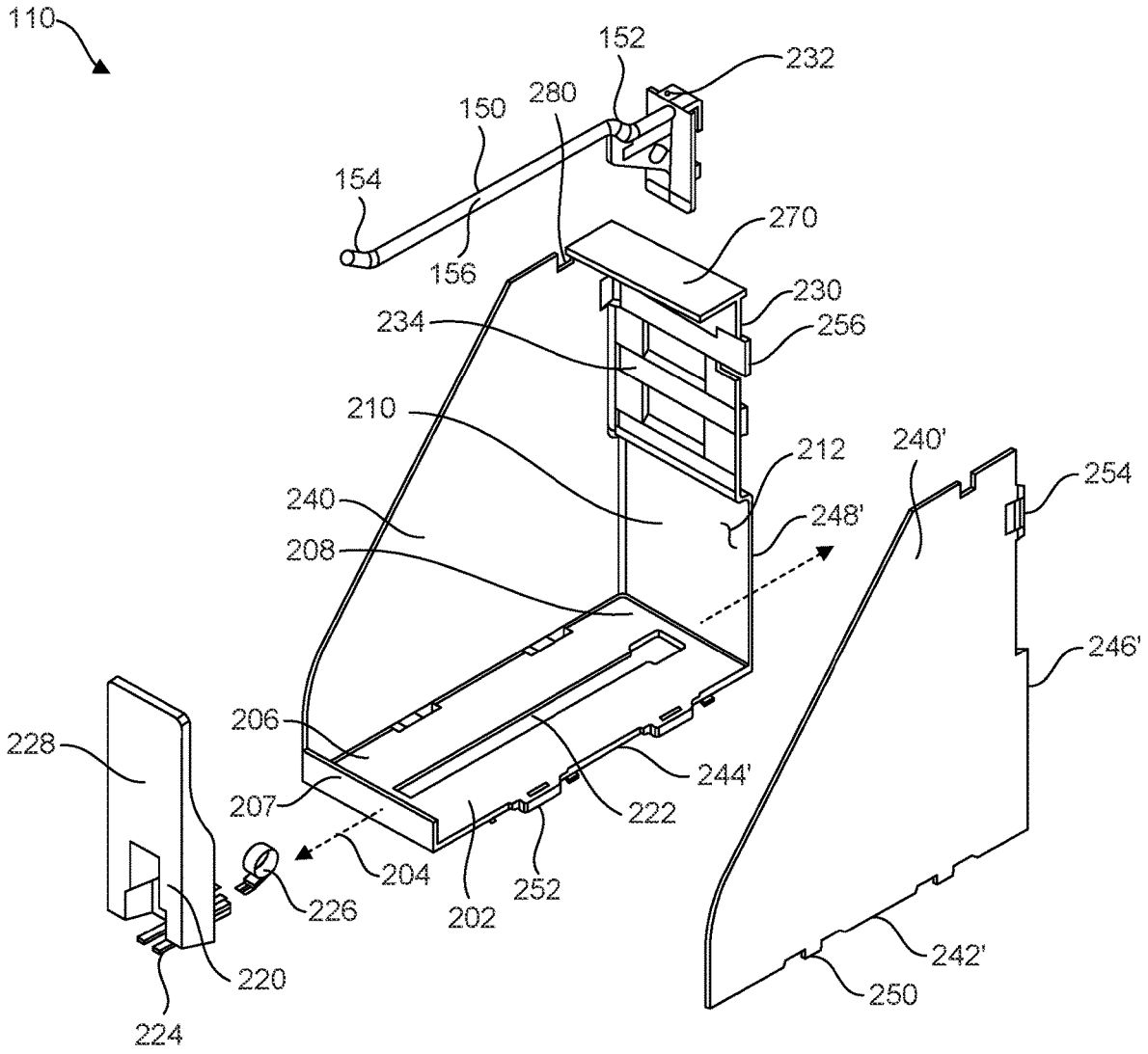
FIG. 2B is an exploded view of the module of FIG. 2A including both side walls.

FIG. 2A shows an embodiment of a module 110 with one of the two side walls omitted. FIG. 2B is an exploded view of the module 110 including both side walls. Turning to FIGS. 2A and 2B, module 110 comprises a body with a base 202. A display axis 204 is defined as running along a length of the base 202 from a front 206 of the base to a rear 208 of the base.

A back wall 210 extends upwards from the rear 208 of the base 202. The back wall 210 has a front surface 212 facing the front 206 of the base 202. In this embodiment, back wall 210 is generally planar with various surface features and substantially normal to the display axis 204.

The hang bar 150 is coupled at a first end 152 to the rear wall 210 and extends outwards from the front surface 212 of the rear wall 210 and over the base 202 ending at a second end 154. The hang bar has an elongated middle portion 156 which can be substantially perpendicular to the display axis 204. Hang bars 150 with different horizontal lengths can be provided. For example a short hang bar 150 may be provided that extends over only a portion of the base 202 while a long hang bar may be provided with a second end 154 that extends beyond the front of the base 206.

A pusher 220 extends upwards from the top surface of the base 202. The pusher 220 is slidably mounted to the base so that it can move front to back along the display axis 204. A spring assembly 226 is coupled to the pusher 220 and configured to bias the pusher towards to the front 206 of the base. The pusher 220 can have various shapes. In an embodiment, pusher 220 has a forward face which includes a generally flat surface 228 that is substantially normal to the display axis 204. When the pusher 220 is pushed backwards and merchandise is suspended from the hang bar 150, the surface 228 of pusher 220 will press against the back of the last displayed unit of merchandise towards the bottom of the unit and urge the that unit forward. A front lip 207 extending upwards at the front 206 of the base 202 can be provided to prevent merchandise from being pushed too far forwards by the pusher and possibly demounting from the hang-bar and falling out of the module 110.

Various mechanisms known to those of ordinary skill in the art can be used to mount the pusher 220 to the base. In an embodiment, a track 222 is formed in the base 202 along the display axis. A coupler 224 on the bottom of the pusher 220 engages the track to retain the pusher 220 within the track 222 while permitting linear motion. A spring 226 is mounted to a front part 202 of the base and unwinds or stretches, depending on the spring configuration, when the pusher is moved backwards.

The hang bar 150 can be removably coupled to the back wall 210. In an embodiment, the end 152 of the hang bar is attached to a mounting bracket 232 which is configured to removably engage mounting hardware 230 on the back wall 210 of module 110. The mounting hardware 230 can be configured to allow the mounting bracket 232 to be attached at different points to allow the height and lateral position of the hang bar 150 to be adjusted. In a particular configuration, the mounting hardware 230 comprises one or more horizontal mounting tracks 234 on the back wall 210 and which can be located at different heights above the base 202. The mounting bracket 232 and mounting tracks 234 can be configured to permit the mounting bracket 152 to engage a mounting track 234 and be horizontally slidably thereon so the lateral position of the mounting bracket can be easily adjusted. Adjusting the lateral position of the hang bar relative to the module 110 allows merchandise with a hang hole that is off center to be hung from the hang bar 150 and still be centered over the base 202.

Module 110 can include a first side wall 240 that has a bottom 242 attached to a first side 244 of the base 202 and a back 246 attached to a first side 248 of the back wall 210. A second side wall 240' can likewise have a bottom 242' attached to a second side 244' of the base 202 and a back 246' attached to a second side 248' of the back wall 210. One or both of the side walls 240, 240' can be removably attached to the module 110 using various mechanisms known to those of ordinary skill in the art. In a particular embodiment, and as illustrated in FIG. 2B, a tab and slot engagement mechanism is used in which a side wall has one or more tabs 250 that engage corresponding slots 252 in the base and one or more slots 254 that engage corresponding tabs 256 extending from the rear wall 210. Other configurations are also possible.

Figure 3:
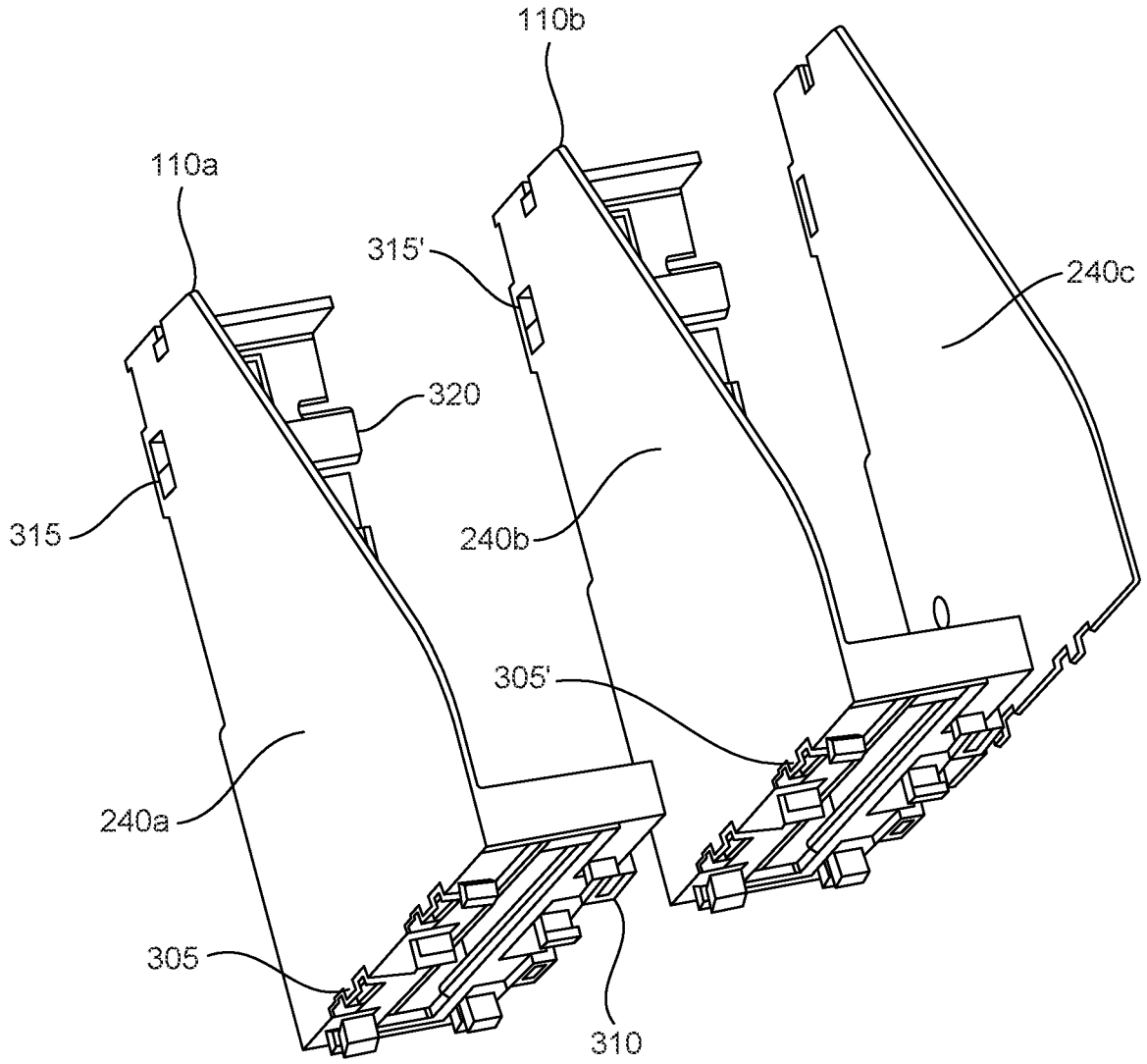
FIG. 3 is an illustration of product display modules showing and embodiment of coupling structures for connecting adjacent modules.

Multiple modules 110 can be combined in a product display system. Turning to FIG. 3 there is shown a pair of modules 110*a*, 110*b*. Each module 110 can include coupling structures to allow one module to be mechanically affixed to an adjacent module in a module array. In an embodiment, one more downward fingers 305 are provided along one bottom edge of a module 110, such as along the bottom 242 of the first side wall 240 as illustrated or other otherwise placed along or near the first side 244 of the base 202. Corresponding slots 310 configured to receive the fingers 305 are formed on the second side 244' of the base 202. Additional opposing mating components can also or alternatively be provided at the back of the modules. In the illustrated embodiment, a tab 320 is provided along the side 248 of the back wall 210 and is configured to engage a corresponding slot 315 in the back part 246 of the side 240 an adjacent module. To join two adjacent modules 110 the two modules are moved so that the coupling fingers 305, 320 engage the corresponding slots 310, 315. Other mating mounting structures can alternatively be used.

As will be appreciated, when two or more modules 110 are joined together adjacent modules can share a side wall. A shown in FIG. 3, module 10*a* has first side wall 240*a*. When module 110*a* is affixed to module 110*b*, side wall 240*b* on module 110*b* serves as a second side wall for module 110*a* wherein side walls 240*a* and 240*b* bound a product display area for module 110. The last module in a row, such as module 110*b* in FIG. 3, can have a discrete second side wall 240*c* to close the side its product display area since there is no further adjacent module. Where both side walls of a module are removable, or where modules are provided in left- and right-handed forms, adjacent modules can be affixed without any side wall between them. This allows for a module configuration to display products that are wider than any single module.

Figure 4:
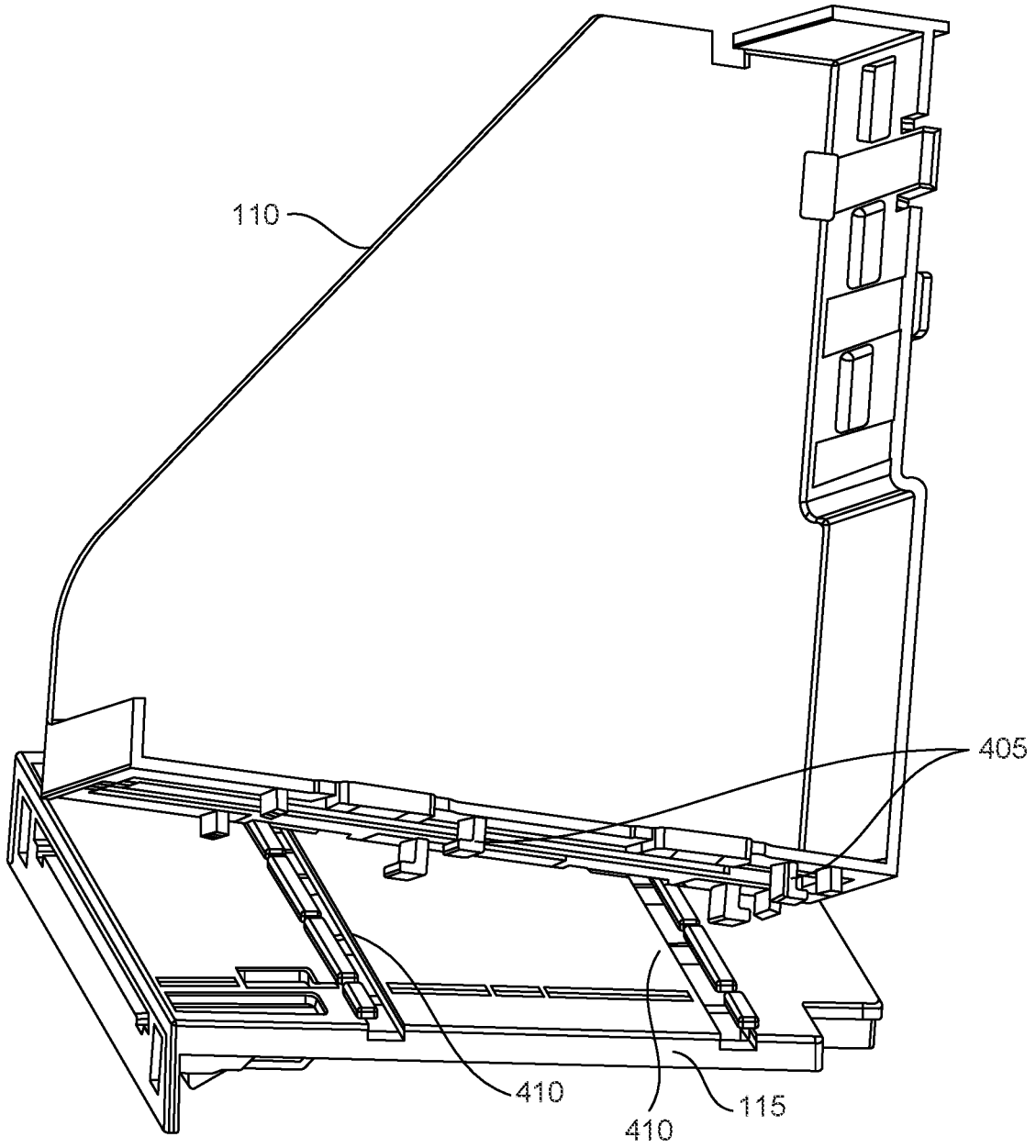
FIG. 4 is an illustration of the product display module of FIG. 2A and an embodiment of a mounting plate with coupling structures.

As noted above, one or more modules 110 can be affixed to a mounting plate 115. FIG. 4 shows one embodiment of a mounting plate 115 wherein mounting structure on the bottom of the base 202 of a module 110 can engage corresponding mounting structure formed in the top surface of the base 115. In a particular embodiment, each module 110 has mounting fingers 405 depending downwards from module base 202 and which are positioned and configured to slidably engage lateral tracks 410 formed in the mounting plate. The shape of the fingers 405 and corresponding tracks 410 can vary. In the disclosed embodiment, fingers 405 are L-shaped and slide into a corresponding L-shaped channels. Other shapes, such as T-shaped fingers and tracks can be used. The engaging structures allow the modules 110 to slide laterally on the mounting plate 115 but prevent the module 110 from being separated vertically from the mounting plate 115. Multiple modules 110 can be ganged together, such as discussed above with respect to FIG. 3, and the collection of physically coupled modules can be slid into a common mounting plate 115 as a combined unit.

Figure 5:
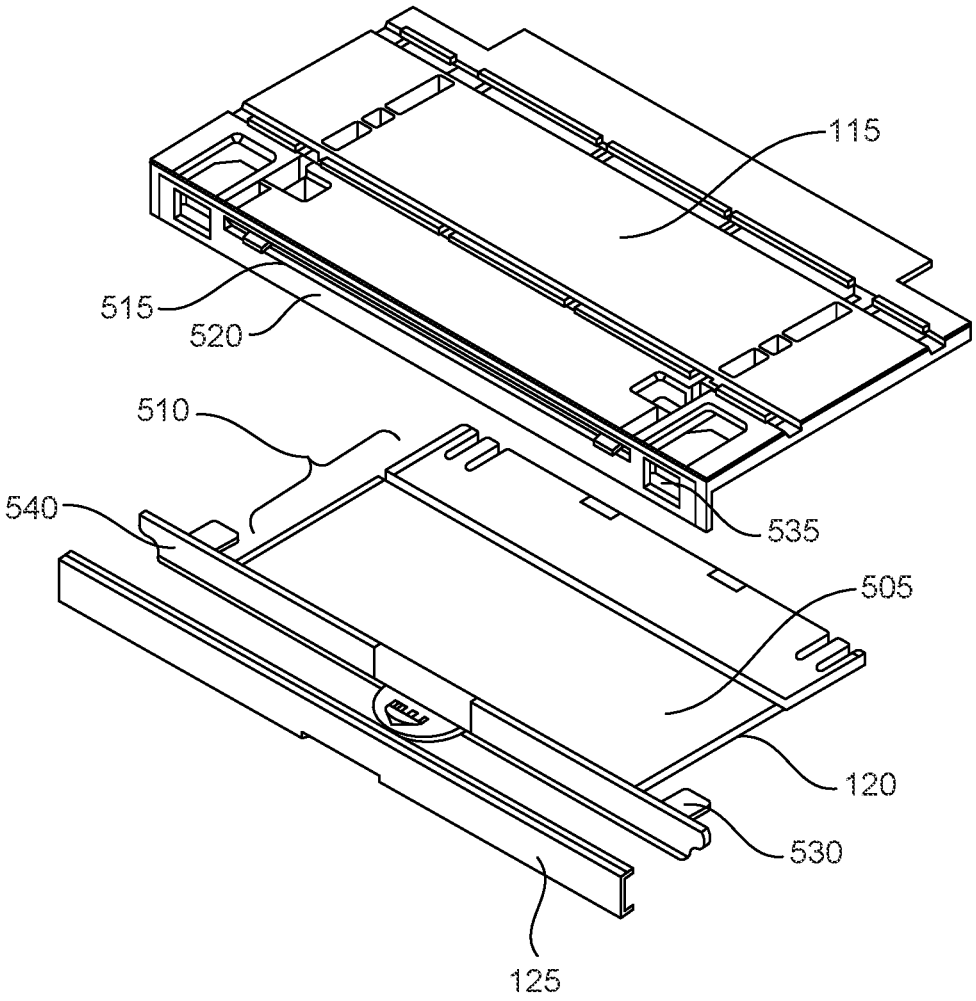
FIG. 5 shows the mounting plate of FIG. 4 with a pullout shelf.

FIG. 5 shows an embodiment of a mounting plate 115 with pull out-shelf 120 and cover plate 125 of FIG. 1B. The pull-out shelf 120 can be mounted under the mounting plate 115 and provides a location for decorative and/or informative content, such as product images, pricing and bar code data to be displayed. In an embodiment shelf 120 has a top surface 505 on which various indicia can be provided.

Indicia can be printed directly on the shelf 120 or on a substrate that is permanently or removably affixed, such as via adhesive.

At least a portion 510 of the shelf 120 is substantially planar and can slide into a horizontal slot 515 formed in a forward face 520 of the mounting plate 115. The shelf 120 can be free floating or mechanisms provided to help retain shelf in place and in a closed position unless deliberately opened. In an embodiment, one or more tabs 530 are provided on the shelf 120 which engage corresponding slots 535 in the forward face 520 of the mounting plate. A friction fit, elastic detent, or other mechanism can be provided to retain the tabs 530 within corresponding slots 535 when the shelf 120 is stowed to help prevent the shelf from extending unless deliberately pulled.

Shelf 120 can also have a forward face 540 and a transparent cover plate 125. Indicia, such as a product name, bar code, and price can be placed between the cover plate 125 and forward lip 540.

Returning to FIG. 1B, the top plate 130 can be configured to mount onto the top of a module 110 or the tops of a group of joined modules 110. Various mechanisms can be used to affix the top plate 130 to tops of modules 110. In the illustrated embodiment, and with further reference to FIGS. 1D and 2B, a horizontal plate 270 extends over the top of the back wall 210 of a module and a notch 280 is formed in the top of the side walls. Fingers 610 and 620 depend downwardly from the bottom of top plate are configured to horizontally slidably engage and capture the horizontal plate 270. Notch 280 is configured and positioned to allow the relevant fingers 620 to pass. When multiple modules 110 are joined together, the top plate 130 can be slid horizontally across all of the modules, capturing the respective horizontal plates 270 of each and further holding the modules 110 together.

Back portion 135 of the indicia holder assembly can include fingers that engage corresponding slots in the top plate 130 to allow for easy mounting a removal without having to remove the top plate 130. A transparent forward cover 140 can be affixed to the back portion and indicia can be inserted between the two components 135, 140.

The various components of the module 110 and display system 100 can be made of conventional materials known to those of ordinary skill in the art. For example, many components can be formed of a relatively rigid molded plastic while certain parts, such as the spring and hang bar are metallic. Other configurations are possible. Some or all of the plastic components can be transparent. For example, one or more of the base, back wall, and side walls can be transparent to allow for improved visibility of the displayed products.

Various aspects, embodiments, and examples of the invention have been disclosed and described herein. The ornamental shape of the various components can also be varied while maintaining the overall functionality of the disclosed system. For example, the cross-sectional shape of the hang bar and shape at its ends can be varied for aesthetic reasons. Likewise the particular shape of the side walls, pusher, and other components can be varied for aesthetic reasons while maintaining the mechanical functionality disclosed herein. Other modifications, additions and alterations may be made by one skilled in the art without departing from the spirit and scope of the invention as defined in the appended claims.

The invention claimed is:

1. A product display module comprising:

a base having a top surface, a front, a rear, and first and second sides, a display axis extending from the front of the base to the rear of the base;

a back wall having a bottom attached to and extending upwards from the rear portion of the base and having a front surface facing the front of the base, a top, and first and second sides;

a hang bar having a first end coupled to the front surface of the back wall, a second end, and an elongated middle portion between the first and second ends, the hang bar extending outward from the front surface of the back wall and over the base;

a pusher extending upwards from the top surface of the base, the pusher slidably coupled to the base and movable along the display axis and under the middle portion of the hang bar; and a spring coupled to the pusher and configured to urge the pusher towards the front of the base.

2. The module of claim 1, wherein the hang bar is removably coupled to the front surface of the back wall.

3. The module of claim 2, further comprising:

a hang bar bracket, the first end of the hang bar attached to the hang bar bracket;

the back wall having a substantially horizontal mounting track, the hang bar bracket slidably engaging the mounting track wherein a position of the hang bar between the first and second sides of the back wall is adjustable.

4. The module of claim 3, the mounting track comprising a plurality of mounting tracks, each respective mounting track at a different distance from the base, the hang bar bracket selectively engagable with each respective mounting track to thereby adjust a height of the hang bar over the base.

5. The module of claim 1, the pusher comprising a forward face which is substantially normal to the display axis.

6. The module of claim 1, further comprising a first side wall having a respective bottom attached to the first side of the base and a respective back attached to the first side of the back wall.

7. The module of claim 6, further comprising a second side wall having a respective bottom attached to the second side of the base and a respective back attached to the second side of the back wall.

8. The module of claim 7, wherein the second side wall is removably attached to the second side of the base and the second side of the back wall.

9. A product display system comprising first and second modules according to claim 6, the first side wall of the second module being adjacent the second side of the back wall of the first module and the second side of the base of the first module, wherein the first side wall of the second module and the first side wall of the first module define a product display area for the first module.

10. The product display system of claim 9, the second module further comprising a second side wall attached to at least one of the second side of the base of the second module and the second side of the back wall of the second module.

11. The product display module of claim 1, wherein the elongated middle portion of the hang bar is substantially parallel to the display axis.

12. A product display system comprising:

a mounting plate having a top surface, a front, and respective first and second sides; and a plurality of modules each respective module comprising:

a base having a top surface, a front, a rear, and first and second sides, a display axis extending from the front of the base to the rear of the base;

a back wall extending upwards from the rear portion of the base and having a front surface facing the front of the base, a top, and first and second sides;

a hang bar having a first end coupled to the back wall, a second end, and an elongated middle portion between the first and second ends, the hang bar extending outward from the front surface of the back wall and over the base;

a pusher extending upwards from the top surface of the base, the pusher slidably coupled to the base and movable along the display axis and under the middle portion of the hang bar; and a spring coupled to the pusher and configured to urge the pusher towards the front of the base;

wherein each respective module is coupled to the top surface of the mounting plate between the first and second sides of the mounting plate and the respective display axes of the plurality of modules are substantially parallel to each other.

13. The product display system of claim 12, each respective module being removably slidably coupled to the mounting plate.

14. The product display system of claim 13, the mounting plate having a mounting channel in the top surface extending across at least a portion of the top surface between the first and second sides of the mounting plate;

each respective module having a finger depending downward from a bottom surface of the respective module base and configured to slideably engage the mounting channel.

15. The product display system of claim 12, the plurality of modules including an end module, each of the plurality of modules being adjacent at last one other module;

each respective module further comprising a first side wall having a respective bottom attached to the first side of the base and a respective back attached to the first side of the back wall, wherein the first side wall of each respective module is adjacent the second side of the back wall and second side of the base of an adjacent module;

the last module further comprising a second side wall having a respective bottom attached to the second side of the base of the last module and a respective back attached to the second side of the back wall of the last module.

16. The product display system of claim 15, the second side wall being removably mounted to the last module.

17. The product display system of claim 12, further comprising a top plate mounted to the plurality of modules and extending over the respective hang bars.

18. The product display system of claim 17, wherein a forward portion of the top plate is configured to removably receive printed indicia.

19. The product display system of claim 12, further comprising a pull-out shelf slidably mounted beneath the mounting plate.

20. A product display system comprising:

a plurality of product display modules, each respective display module comprising a body with a base having a front, a rear, and first and second sides, a back wall extending upwards from the base and having a top and first and second sides, a first side wall adjacent the first side of the base and the first side of the back wall, a hang bar coupled to the back wall and extending over the base, and a spring loaded pusher assembly slidably mounted to the base and configured to urge products suspended from the hang bar towards a front of the module;

the respective modules arranged linearly from a first module to a last module, wherein the first side wall of each module other than the first module is adjacent the second side of the base and the second side of the back wall of an adjoining module;

the last module further comprising a second side wall adjacent the first side of the base and the first side of the back wall of the last module;

a mounting plate having a mounting channel in the top surface extending across at least a portion of the top surface between the first and second sides of the mounting plate;

each respective module having a finger depending downward from a bottom surface of the respective module base and slideably engaging the mounting channel, wherein the plurality of modules are secured to the mounting plate.

21. The product display system of claim 20, wherein each of the plurality of modules is directly mechanically coupled to at least one adjacent module.

22. The product display system of claim 20, further comprising a top plate mounted to the plurality of modules and extending over the respective hang bars.

23. The product display system of claim 20, each respective module further comprising:

a substantially horizontal mounting track in the back wall of the respective module; and a hang bar bracket slidably engaging the respective module, the hang bar in the respective module attached to the respective hang bar bracket, wherein a position of the hang bar along the back wall of the respective module is adjustable.

24. The product display system of claim 20, the pusher assembly in each respective module slidable along a respective display axis;

the hang bar in each respective module comprising an elongated middle portion between first and second ends, the elongated middle portion being substantially parallel to the respective display axis.

25. A product display module comprising:

a base having a top surface, a front, a rear, and first and second sides, a display axis extending from the front of the base to the rear of the base;

a back wall extending upwards from the rear portion of the base and having a front surface facing the front of the base, a top, and first and second sides;

a hang bar having a first end, a second end, and an elongated middle portion between the first and second ends;

a hang bar bracket attached to the first end of the hang bar, the back wall having a substantially horizontal mounting track, the hang bar bracket removably coupled to the back wall so that the hang bar extends outward from the front surface of the back wall and over the base, the hang bar bracket slidably engaging the mounting track wherein a position of the hang bar between the first and second sides of the back wall is adjustable;

a pusher extending upwards from the top surface of the base, the pusher slidably coupled to the base and movable along the display axis and under the middle portion of the hang bar; and a spring coupled to the pusher and configured to urge the pusher towards the front of the base.

26. The module of claim 25, the mounting track comprising a plurality of mounting tracks, each respective mounting track at a different distance from the base, the hang bar bracket selectively engagable with each respective mounting track to thereby adjust a height of the hang bar over the base.

* * * * *